US009090104B2

(12) United States Patent
Hoepner et al.

(10) Patent No.: US 9,090,104 B2
(45) Date of Patent: Jul. 28, 2015

(54) DEVICE AND METHOD FOR SERIAL PRINTING OF PRINT MEDIA

(71) Applicant: BOEWE SYSTEC GmBH, Augsburg (DE)

(72) Inventors: Bernd Hoepner, Augsburg (DE); Arne Brueck, Augsburg (DE)

(73) Assignee: BOEWE SYSTEC GMBH, Augsburg (DE)

( * ) Notice: Subject to any disclaimer, the term of this patent is extended or adjusted under 35 U.S.C. 154(b) by 0 days.

(21) Appl. No.: 13/799,687

(22) Filed: Mar. 13, 2013

(65) Prior Publication Data

US 2013/0286126 A1 Oct. 31, 2013

(30) Foreign Application Priority Data

Apr. 27, 2012 (DE) ..... 10 2012 103 712

(51) Int. Cl.

| | |
|---|---|
| ***B41J 2/01*** | (2006.01) |
| ***B41J 11/00*** | (2006.01) |
| ***B41J 11/20*** | (2006.01) |
| ***B41J 13/08*** | (2006.01) |
| ***B41J 13/12*** | (2006.01) |
| ***G07B 17/00*** | (2006.01) |

(52) U.S. Cl.

CPC ..... *B41J 11/007* (2013.01); *B41J 11/0085* (2013.01); *B41J 11/20* (2013.01); *B41J 13/08* (2013.01); *B41J 13/12* (2013.01); *G07B 17/00467* (2013.01); *G07B 17/00508* (2013.01); *G07B 2017/00524* (2013.01)

(58) Field of Classification Search

CPC .. B41J 11/0065; B41J 11/007; B41J 11/0085; B41J 11/06; B41J 13/103

USPC ..... 347/104; 271/3.14, 3.18

See application file for complete search history.

(56) References Cited

U.S. PATENT DOCUMENTS

| | | | | |
|---|---|---|---|---|
| 5,189,442 | A * | 2/1993 | Herbert | 347/2 |
| 5,321,436 | A | 6/1994 | Herbert | |
| 2006/0028524 | A1* | 2/2006 | Kawauchi et al. | 347/103 |
| 2007/0165092 | A1* | 7/2007 | Kito | 347/102 |
| 2007/0206038 | A1* | 9/2007 | Baker | 347/8 |
| 2008/0226377 | A1 | 9/2008 | Hatano et al. | |
| 2008/0266372 | A1* | 10/2008 | Koike | 347/104 |
| 2009/0148209 | A1* | 6/2009 | Ikegami | 399/364 |

(Continued)

FOREIGN PATENT DOCUMENTS

DE 10051767 A1 5/2002

*Primary Examiner* — Geoffrey Mruk
*Assistant Examiner* — Bradley Thies
(74) *Attorney, Agent, or Firm* — Fleit Gibbons Gutman Bongini & Bianco PL; Martin Fleit; Paul D. Bianco

(57) ABSTRACT

A device for serial printing of print media, particularly mail-pieces, with a print head having a planar printing face and a printing area extending longitudinally, and with a transport device for feeding print media to be printed to the print head. The transport device includes first and second transport units, which move the print media parallel to the printing face and can be moved in an orthogonal direction relative to the printing face in order to guide a print medium on the transport units to the printing face of the print head and at a distance away from the printing face that is suitable for printing. The first and second transport units can be moved independently of one another and a transfer area of the printing face is provided to transfer a print medium from the first to the second transport unit.

16 Claims, 9 Drawing Sheets

(56) References Cited

U.S. PATENT DOCUMENTS

2009/0160889 A1* 6/2009 Holbrook et al. ..... 347/8
2011/0074844 A1 3/2011 Holbrook et al.
2011/0134200 A1* 6/2011 Ikegami ..... 347/104
2012/0001992 A1* 1/2012 Yamamoto et al. ..... 347/104

* cited by examiner

DEVICE AND METHOD FOR SERIAL PRINTING OF PRINT MEDIA

CROSS REFERENCE TO RELATED APPLICATIONS

This application claims priority under 35 U.S.C. §119 to German Patent Application No. 10 2012 103 712.4 filed 27 Apr. 2012, the entire contents of which are incorporated herein by reference.

FIELD OF THE INVENTION

The invention relates to a device for serial printing of print media and to a method for serial printing of print media.

BACKGROUND OF THE INVENTION

A method is known from US 2011/0074844 A1 for printing print media in which the media to be printed are supplied by means of a transport device to a print head. The transport device comprises several conveyor belts articulated to one another and arranged in series in the transport direction, wherein a central conveyor belt is located underneath the print head and is height-adjustable relative to the print head in order to adjust a suitable distance between the print medium to be printed and the print head when the print medium is situated underneath the print head. The central conveyor belt has an articulated connection to the adjacent conveyor belts, wherein the upstream conveyor belt in the transport direction forms a supply ramp and the downstream conveyor belt in the transport direction forms a discharge ramp for the print media.

In order to bring the print medium to be printed to the print head with a suitable spacing between the surface to be printed on the print medium and a printing face of the print head, the thickness of the print medium is first detected while the print medium is being transported by the transport device. When a print medium to be printed is situated on the central conveyor belt underneath the print head, the central conveyor belt is shifted to a suitable height relative to the print head in order to adjust a distance suitable for printing between the surface of the print medium to be printed and the printing face of the print head, taking the detected thickness of the print medium into account. As soon as the print medium is a suitable distance from the print head and is located underneath the print head, the printing process is started, wherein the print medium is moved in the transport direction at a speed suitable for printing. After printing, the printed print medium is transferred from the central conveyor belt to the conveyor belt downstream in the transport direction and is transported away.

This known arrangement for serial printing of print media proves disadvantageous especially if the print head is a print head that has a certain longitudinal elongation in the transport direction of the media to be printed. This is the case for inkjet print heads, for example, in which a number of inkjet nozzles (possibly for different inks) are arranged one after the other and separated from one another in the longitudinal direction of the print head (and thus in the transport direction of the print media to be printed). Other print heads as well, such as laser print heads, have a certain longitudinal elongation in the longitudinal direction of the print head. The result of this is that the height-variable transport device with which the print media to be printed are serially fed to the print head cannot be varied in height relative to the print head during the printing of a print medium that has been brought on the central conveyor belt to the print head, because the print medium located on the central conveyor belt must be kept a suitable distance away from the print head during printing. For this reason, subsequent print media cannot be transferred to the central conveyor belt and brought thereby to a suitable distance from the print head until the preceding print medium is finished with printing and transferred to the downstream conveyor belt. This causes a reduction of the possible transport speed of the transport device for feeding and discharging the print medium, and reduces the throughput of the printing device.

SUMMARY OF THE INVENTION

Starting from this point, certain embodiments of the invention address the problem of specifying a device and a method for serial printing of print media with which a faster feeding and removal of the print media is made possible. In particular, the throughput of printed print media in the printing device is to be increased.

The device according to the invention is particularly suitable for printing mailpieces such as envelopes on which, for example, the recipient and sender addresses and/or a postage imprint and/or promotional imprints are to be printed. The device according to the invention for serial printing of print media comprises a print head extending in a longitudinal direction with a planar printing face and a printing area extending in the longitudinal direction. The device according to the invention further comprises a transport device for feeding the print media to be printed to the print head, wherein the transport device comprises at least one first transport unit and a second transport unit, which can be moved independently of one another in a transport direction and in an orthogonal direction relative to the printing face of the print head in order to feed a print medium guided on the transport units to the printing face of the print head and to bring the surface of the print medium that is to be printed to a suitable distance from the printing face. According to the invention, the transport device comprises a transfer area located in the printing area of the printing face, so that a print medium can be transferred from the first transport unit to the second transport unit in the transfer area and thus inside the printing area of the printing face. Several transfer areas arranged one after another in the longitudinal direction inside the printing area can also be provided.

This arrangement of one or more transfer areas in the printing area of the print head allows a print medium to be transferred from the first transport unit to the second transport unit before or during printing, or at the latest directly after termination of the printing. Thereby the positioning of the upstream transport unit as viewed in the transport direction relative to the printing face can already be adjusted to the next print medium, which is to be printed after the print medium that is currently in the printing area. This next print medium can possibly have a different thickness than the print medium that is currently in the printing area. The position of the upstream transport unit relative to the printing face can thus be adapted if necessary, even during the printing of the print medium that is currently in the printing area, or immediately after the printing process is finished. There is therefore a faster adjustment of the positioning of the upstream transport unit with respect to the printing face, taking into account the thickness of the subsequent print medium as viewed in the transport direction. Thereby the transport device can be run at a higher feeding and discharge speed. In addition, a smaller distance between successive print media being serially fed with the transport device to the print head can be selected. An increased throughput of the printing device can be achieved with both measures.

According to the invention, the first transport unit and the second transport unit in the device for serial printing of print media can be moved in the orthogonal direction relative to the printing face independently of one another in order to adjust suitable distances between the transport surfaces of the first and the second transport units with respect to the printing face. Both the first transport unit and the second transport unit are advantageously coupled to a drive unit for this purpose. The drive unit can be a servomotor or a linear motor, for example. Each drive unit expediently comprises a counterweight to compensate for mass forces.

A thickness measuring device arranged upstream of the print head in the transport direction is expediently provided for detecting the thickness of the print media that are to be printed and are being serially transported to the print head by means of the transport device. The thickness measurement device can be a rotary encoder, for example. An optical sensor that detects the thickness of the print media by means of a triangulation process is preferred for detecting the thickness of the print media. The thickness of each print medium detected by the thickness measuring device is taken into account in adjusting the positions of the first and/or the second transport units relative to the printing face of the print head in order to guarantee that the surfaces of the print media to be printed, possibly having different thicknesses, arrive at a suitable distance from the printing face during the printing process.

In a preferred embodiment, the transport device of the device according to the invention has a first conveyor belt and a second conveyor belt, each conveyor belt being guided at its upstream end and at its downstream end via a roller. At least one of the rollers of each conveyor belt is driven by a motor.

The conveyor belts of the first transport unit and the second transport unit are each preferably constructed as suction belts, which attract the print medium on the transport surface by means of negative pressure.

In one embodiment of the device according to the invention, the transfer area of the transport device is formed by an overlap area in which the two transport devices overlap in the longitudinal direction. For this purpose, the two transport units are expediently arranged laterally offset one alongside the other. The extension of the overlap area in the longitudinal direction expediently also substantially corresponds to the longitudinal extension of the printing area of the print head.

To achieve a secure transfer of a print medium from the first transport unit to the second transport unit, the transport surfaces of the two transport units are expediently at the same level during the transfer of the print medium.

In a preferred embodiment of the device according to the invention, the first transport unit and/or the second transport unit can be pivoted with respect to the printing face. This allows an inclination of the transport surfaces of the transport unit relative to the printing face. The inclination of the transport surfaces expediently runs in the direction perpendicular to the transport direction. This embodiment of the device according to the invention is suitable for serial printing of print media with a thicknesses that vary over their width or length. An inclination of the transport surfaces for the transport unit can guarantee that the surfaces of the print media to be printed lying on the transport surfaces of the transport units can be brought into a plane parallel to the printing face.

BRIEF DESCRIPTION OF THE DRAWINGS

These and further advantages of the invention follow from the embodiment described below with reference to the accompanying drawings. The drawings show.

DETAILED DESCRIPTION OF THE INVENTION

Figure 1:
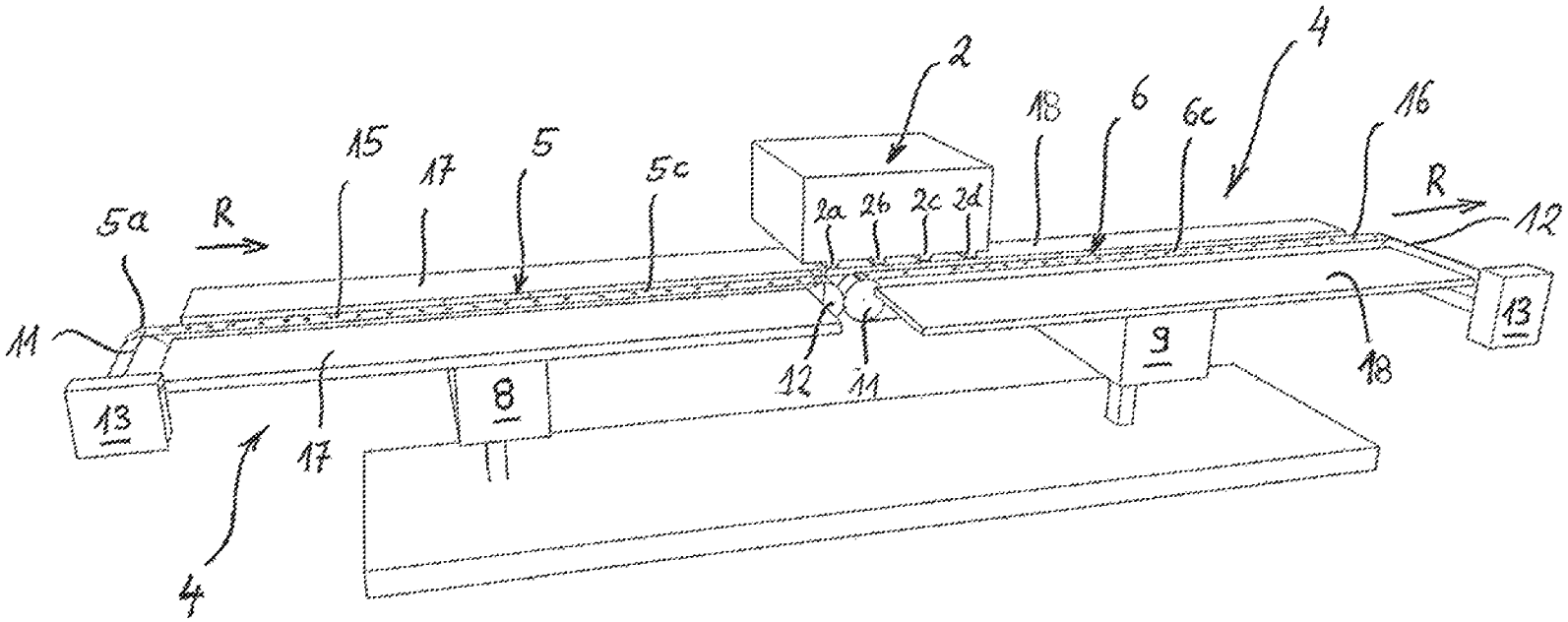
FIG. 1: a schematic representation in a perspective view of a first embodiment of a device according to the invention for serial printing of print media.

FIG. 1 shows a first embodiment of a device according to the invention for serial printing of print media. The print media to be printed can be mailpieces, for example, such as letter envelopes on which a recipient and sender imprint and optionally the postage imprint and/or promotional imprints are imprinted. The device according to the invention can also be used for printing other print media, however. The device according to the invention is particularly suitable for serial printing of print media having different geometries and especially different thicknesses. The device according to the invention is equipped for this purpose with a transport device 4 and a print head 2, wherein the transport device 4 transports the print media to be printed in a transport direction R, colinear with the longitudinal direction of the transport device, to the print head 2 and transports them away from the print head 2 after printing. The transport device 4 can also be repositioned relative to the print head in a direction orthogonal to the transport direction, in order to be able to adjust a distance relative to the print head that is suitable for printing the print media. This adjustment mechanism can be seen from the following description of the embodiment of FIG. 1.

The print head 2, which can be an inkjet print head, has a housing and several printing nozzles 2*a*, 2*b*, 2*c*, 2*d* arranged separated from one another in the longitudinal direction. The printing nozzles are inkjet printing nozzles, for example. The exit faces of the printing nozzles form a planar printing face 3, which extends in the longitudinal direction (i.e. in the transport direction R of the transport device) across a printing area 3*a*, which extends from the front printing nozzle 2*a* to the rear printing nozzle 2*d*. The printing face 3 is expediently in a horizontal plane; a different arrangement of the print head is also possible. As an alternative to an inkjet print head, a laser print head can also be used, which similarly has a flat printing face 3 and a printing area 3*a* extending in the longitudinal direction.

In the embodiment of FIG. 1, the transport device 4 comprises a first transport unit 5 and a second transport unit 6. The transport units 5 and 6 each comprise a conveyor belt 15 and 16, expediently configured as suction belts. Each suction belt 15, 16 has a plurality of openings that are arranged separated from one another in the longitudinal direction of the respective conveyor belt 15, 16. A negative pressure can be applied to each suction belt 15, 16 in order to hold the print medium lying on the transport surface 5*c* or 6*c* on the upper run of the suction belts 15, 16. The transport surfaces 5*c* and 6*c* of the conveyor belts 15 and 16 expediently move synchronously in the transport direction R in order to transport a print medium lying on the respective transport surface 5*c* or 6*c* in the transport direction R. As viewed in the transport direction R, the upstream conveyor belt 15 of the first transport unit 5 is guided at its upstream end 5*a* via a first roller 11 and by a second roller 12 at its downstream end 5*b*. In the embodiment shown in FIG. 1, the first roller 11 is rotationally driven by a first motor 13 in order to move the conveyor belt 15 in the transport direction R. The conveyor belt 16 of the second transport unit 6 is correspondingly guided at its upstream end 6*a* via a first roller 11 and via a second roller 12 at its downstream end 6*b*, the second roller 12 being driven by a motor 13 in the embodiment shown in FIG. 1 in order to move the conveyor belt 16 of the second transport unit 6 in the transport direction R.

Transport supports 17 and 18 are arranged transverse to the transport direction R on either side of the conveyor belts 15 and 16. The transport supports 17 and 18 are respectively used for guiding the print medium on the transport surfaces 5*c* and 6*c* during transport in the first transport unit 5 and the second transport unit 6.

Both the first transport unit 5 and the second transport unit 6 can be moved vertically relative to the transport direction R, with respect to the stationary print head 2. For this purpose, a drive 8 is provided on the first transport unit 5 and a drive 9 is provided on the second transport unit 6. The drives 8, 9 can be servomotors or a linear motors. The two transport units 5 and 6 can be moved independently of one another by the drives 8 and 9 in a direction perpendicular to the transport direction R and relative to the print head 2. Thereby the first transport unit 5 can be positioned independently of the second transport unit 6 in such a manner with respect to the stationary print head 2 that the distance between the transport surface 5*c* and the printing face 3 of the print head 2 can be adjusted continuously within predetermined limits. The distance between the transport surface 6*c* of the second transport unit 6 and the printing face 3 of the print head 2 can be correspondingly adjusted continuously within predetermined limits and independently of the positioning of the first transport unit 5.

The two transport units 5 and 6 are arranged one after another in the longitudinal direction and are aligned with one another. The downstream end 5*b* of the first transport unit 5 adjoins the upstream end 6*a* of the second transport unit 6. The downstream end 5*b* of the first transport unit 5 and the upstream end 6*a* of the second transport unit 6 form a transfer area 7. A print medium can be transferred from the first transport unit 5 to the second transport unit 6 in this transfer area 7. The exact length of the transfer area 7 in the longitudinal direction depends on the dimensions of the print media to be transported. The transfer area 7 is defined by the area in the longitudinal direction in which a secure transfer of a print medium from the first transport unit 5 to the second transport unit 6 can take place.

Figure 2:
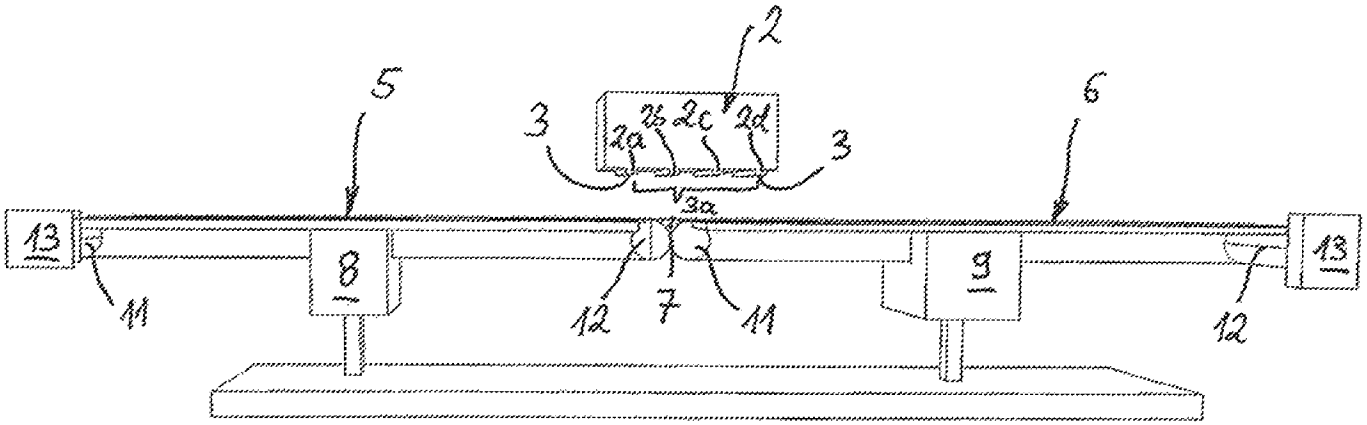
FIG. 2: a side view of the device of FIG. 1.

As can be seen particularly from the side view of FIG. 2, this transfer area 7 is located underneath the print head 2 which is arranged in the embodiment of FIGS. 1 and 2 in such a manner that the printing face 3 is in a horizontal plane. The transfer area 7 lying underneath the print head 2 is situated inside the printing area 3*a* of the print head 2, i.e. between the front printing nozzle 2*a* and the rear printing nozzle 2*d* in the longitudinal direction. In order to guarantee a secure transfer of a print medium from the first transport unit 5 to the second transport unit 6, the positions of the transport units 5 and 6 are advantageously adjusted by means of the drives 8 and 9 in such a manner that the transport surfaces 5*c* and 6*c* are in the same position (i.e. at the same height) during the transfer.

Figure 4:
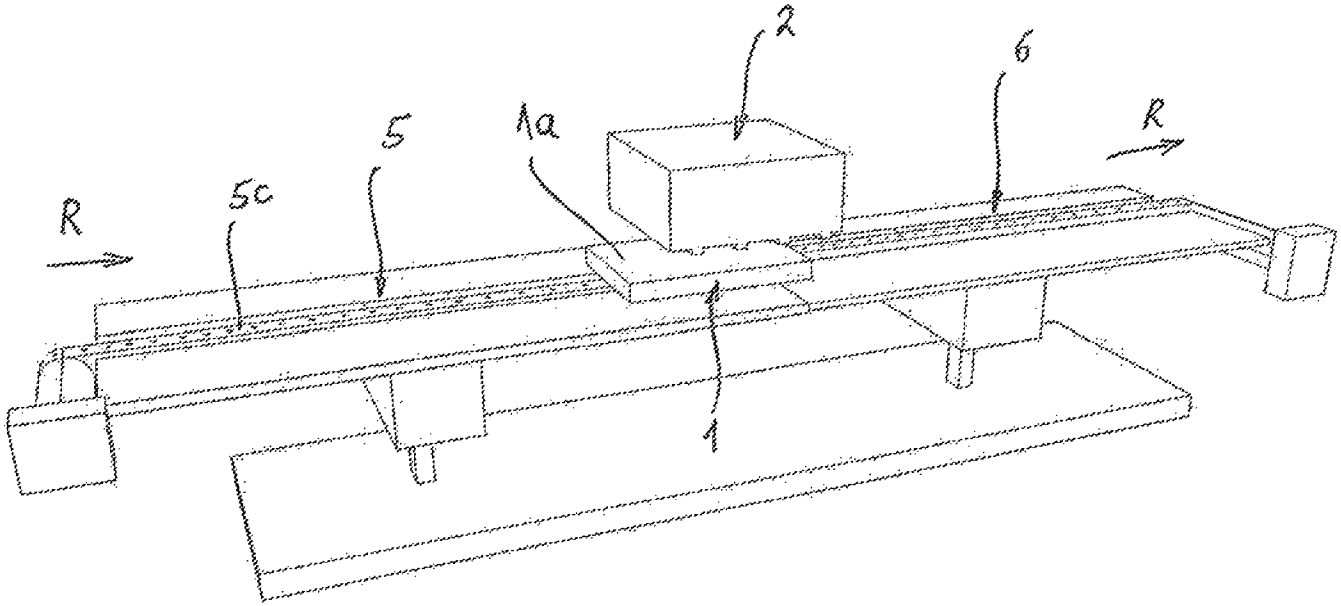
FIG. 4: schematic representation of a device according to the invention for serial printing of print media, with a print medium located underneath the print head.
Figure 5:
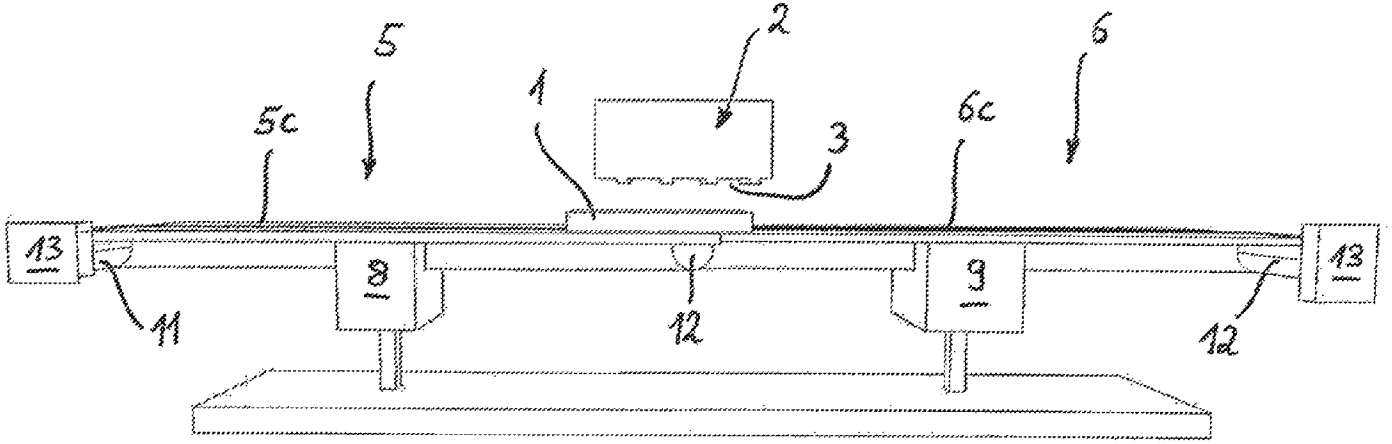
FIG. 5: a side view of the device of FIG. 4 with the print medium to be printed.

FIGS. 4 and 5 schematically show the feeding of a print medium 1 to the print head 2 in a perspective view and a side view, respectively. In order to feed the print medium 1 to the print head 2 with which the print medium 1 is to be printed, the print medium 1 on the transport surface 5*c* of the first transport unit 5 is moved by the transport unit 5 in the transport direction R to the print head 2. To bring the surface 1*a* of the print medium 1 to a distance from the printing face 3 that is suitable for printing, the position of the first transport unit 5 is moved by means of the drive 8 with respect to the printing face 3.

The exact positioning of the first transport unit 5 relative to the print head 2 results from the suitable distance between the surface 1*a* of the print medium 1 and the thickness of the print medium. To detect the thickness of the print medium, a thickness measurement device, not shown here, is therefore provided, and is arranged upstream of the print head 2 in the transport direction R. The thickness measurement device can be a rotary encoder, for example. However, an optical sensor is preferably used for detecting the thickness of the print media 1. An optical sensor that determines the thickness of the print media 1 by means of an optical triangulation method has proved particularly suitable in this regard.

The thickness as detected by the thickness measurement device for each print medium 1 being fed by the transport device 4 to the print head 2 is transferred to a control unit (not shown here), and the control unit determines the position of the transport unit 5 that is to be set with respect to the print head 2, taking into account the suitable printing distance between the surface 1*a* of the print media 1 and the printing face 3 of the print head 3. The thus-determined optimal position of the first transport unit 5 is then adjusted via the drive 8, and the print medium 1 to be printed is brought in this position to the print medium 2 by the first transport unit 5. When the front edge of the print medium 1 is at the upstream start of the printing area 3 as viewed in the transport direction R, the printing process begins. During printing, the print medium is moved farther in the transport direction R by the first transport unit 5, until the rear edge of the print medium 1 has reached the rear edge of the printing area 3 and the printing is finished. After the end of the printing process, the finished print medium 1 is transferred from the first transport unit 5 to the second transport unit 6. In the embodiment shown in FIGS. 1 and 2, the transfer takes place by switching the negative pressure on and off in the suction belts 15 and 16 of the first transport unit 5 and the second transport unit 6, respectively. After the finished print medium 1 has been transferred from the first transport unit 5 to the second transport unit 6, the finished print medium 1 is transported farther in the transport direction R by the second transport unit 6 and is then transferred to an additional transport unit or a processing unit (not shown here) arranged downstream, as viewed in the transport direction R.

In an alternative process design, the print medium 1 is transferred from the first transport unit 5 to the second transport unit 6 already during printing, i.e. while the print medium 1 is in the printing area 3*a* of the print head 2. It is also possible with the device according to the invention to transfer the print medium 1 to be printed from the first transport unit 5 to the second transport unit 6 even before the beginning of the printing process. The print medium 1 is always transferred in the transfer region 7, which is situated in the printing area 3*a* of the printing face 3. In the embodiment shown in FIGS. 1 and 2, in which the printing face 3 is in a horizontal plane, the printing area 3*a* is defined by the area extending in a longitudinal direction between the front printing nozzle 2*a* and the rear printing nozzle 2*d*. If other print heads that do not have a plurality of sequentially arranged printing nozzles are used, the printing area 3*a* is defined by the area extending in a longitudinal direction in which the print head 2 outputs printing ink.

Figure 6:
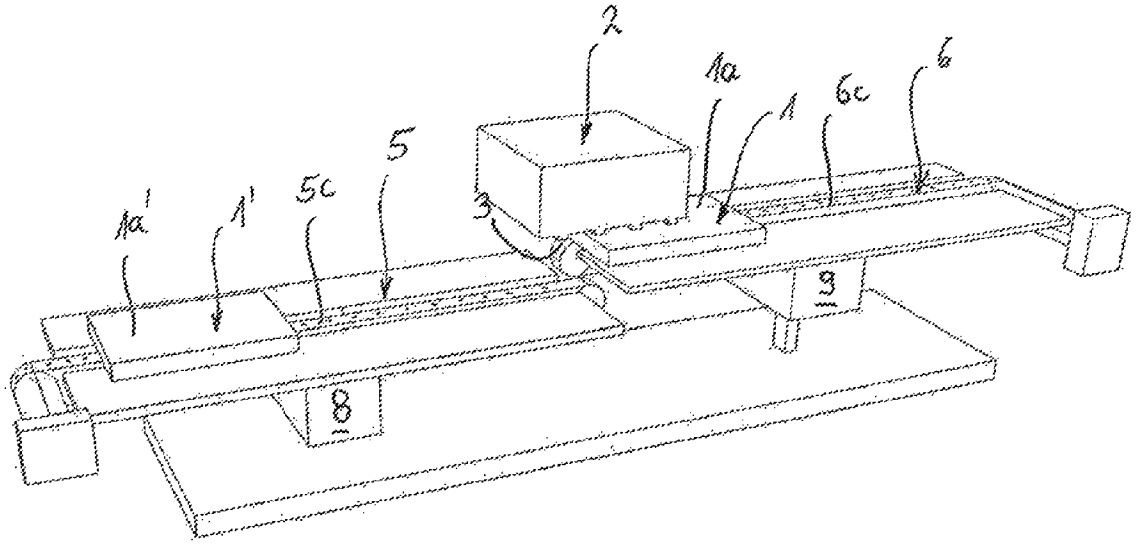
FIG. 6: perspective view of the device of FIG. 4 with a first print medium to be printed, which is situated underneath the print head while being printed, and a second, still unprinted print medium, which is being fed by the transport device to the print head.
Figure 7:
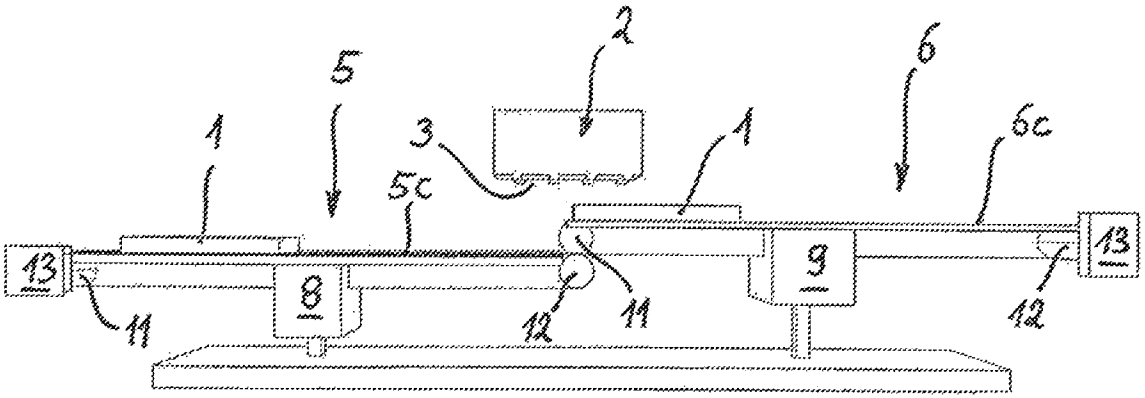
FIG. 7: side view of the representation of FIG. 6.

The serial feeding of print media 1 to the print head 2 and the discharge therefrom after printing are shown in FIGS. 6 and 7. FIGS. 6 and 7 show a first print medium 1, which is situated on the transport surface 6*c* of the second transport unit 6 and inside the printing area 3*a* and is being printed. A second print medium 1' is located on the transport surface 5*c* of the first transport unit 5. The second transport unit 6 transports the print medium 1 through the printing area 3*a* of the print head 2 during the printing and is in a position in which the surface la of the print medium 1 has a distance from the printing face 3 of the print head 2 that is suitable for printing. In contrast thereto, the first transport unit 5 is in a lower position relative to the print head 2. In this position, the transport unit 5 transports a second print medium 1' yet to be printed to the print head 2. Due to the independent adjustment of the positions of the first transport unit 5 and the second transport unit 6 relative to the print head 2, it is possible to adjust the position (the height in the illustrated embodiment) of the first transport unit 5 relative to the print head 2 to the thickness of the print medium 1' in order to adjust the optimum distance of the printing surface 1*a'* from the printing face 3. Because the print medium 1' can have a different thickness than the previous print medium 1, the first transport unit 5 can be adjusted—independently of the position of the second transport unit 6—relative to the print head 2 in such a manner that the surface 1*a'* of the print medium 1' has a distance from the printing face 3 of the print head 2 that is suitable for printing. Thereby the position of the first transport unit 5 can already be adjusted to the thickness of the print medium 1' while the preceding print medium 1 is still in the printing area 3*a* of the print head 2 and is being printed there.

Figure 3:
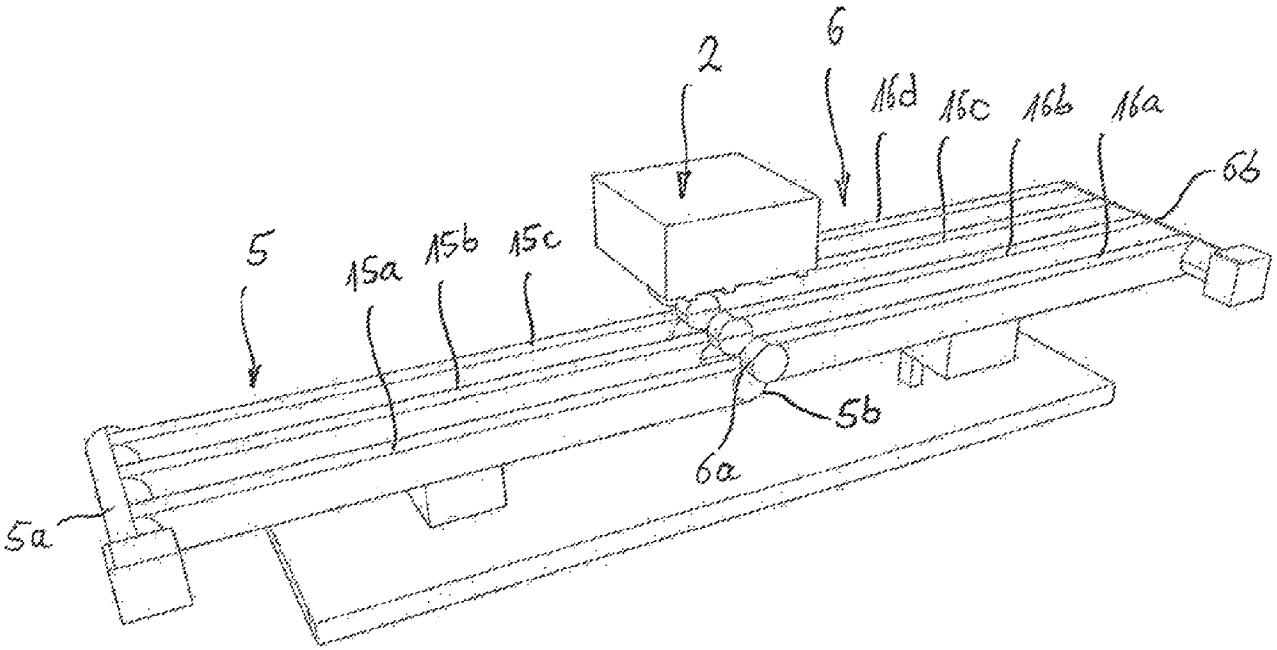
FIG. 3: a schematic representation in a perspective view of a second embodiment of a device according to the invention for serial printing of print media.

The invention is not limited to the example shown in FIGS. 1 and 2. FIG. 3, for example, shows a second embodiment of a device according to the invention, in which the first transport unit 5 comprises several conveyor belts 15*a*, 15*b* and 15*c* running parallel to one another and in the longitudinal direction and arranged separated from one another in the transverse direction. The second transport unit 6 correspondingly also comprises several conveyor belts 16*a*, 16*b*, 16*c* and 16*d* arranged separated from one another in the transverse direction. The conveyor belts 15*a*, 15*b* and 15*c* of the first transport unit 5 are also arranged offset from the conveyor belts 16*a*, 16*b*, 16*c* and 16*d* of the transport unit 6 in the transverse direction. The transfer area 7, which is provided for transferring a print medium from the first transport unit 5 to the second transport unit 6, is formed in this case by an overlap area, in which the two transport units 5 and 6 overlap in the longitudinal direction. In order to form the overlap area, the downstream end 5*b* of the first transport unit 5 is located downstream of the upstream end 6*a* of the second transport unit 6. The extent of the overlap 7 in the longitudinal direction expediently corresponds substantially to the longitudinal extent of the printing area 3*a* of the print head 2.

In another embodiment, not shown in the drawings, the first transport unit 5 and the second transport unit 6 comprise conveyor rollers arranged sequentially in the longitudinal direction rather than conveyor belts. The conveyor rollers can be separately driven by a motor associated with each conveyor roller. It is also possible to provide only a single motor for driving the conveyor rollers and to couple the rollers to one another via a drive belt. Several transfer areas 7 arranged one after another longitudinally and inside the printing area 3*a* can also be provided.

In a preferred embodiment of the device according to the invention, a single motor 13 is provided for driving the two transport units 5 and 6 in the transport direction R. The first transport unit 5 is driven directly with this motor. The second transport unit 6 is connected to the motor via a coupling. In this embodiment variant, it is possible to adjust a different transport speed of the first transport unit 5 relative to the second transport unit 6. This makes it possible, for instance, to adjust a faster discharging of the already finished print medium with the second transport unit 6 in comparison to the feeding transport of the still unprinted print media to the print head 2 by the first transport unit 5.

In a preferred embodiment of the device according the invention, the control unit for the device is to be programmed in such a manner that a print medium situated on the first transport unit 5 is transferred to the second transport unit 6 and transported farther in the transport direction R thereby as soon as the print medium is in the transfer area 7.

In order to compensate the flywheel mass, it is further provided in an embodiment (not shown) that the two drives 8, 9 are each provided with a counterweight for compensating the mass forces. This allows a vibration-free approach of the transport units 5, 6 to the print head 2.

Figure 8:
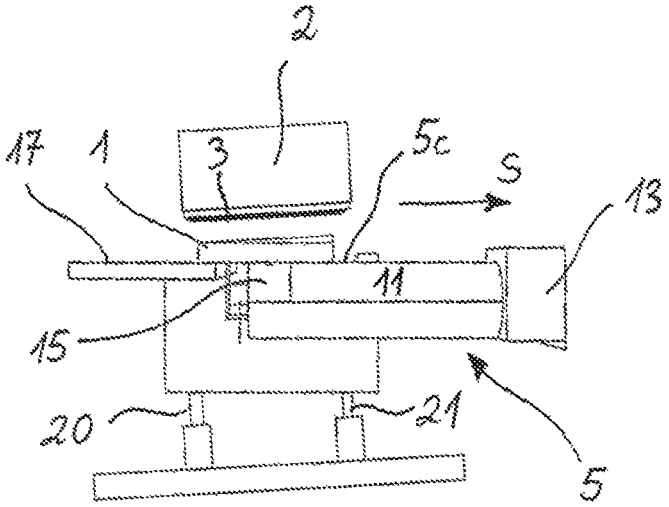
FIG. 8: representation of a third embodiment of a device according to the invention for serial printing of print media, viewed in the transport direction.

FIGS. 7 and 8 show two embodiments of the device according to the invention that are particularly suitable for serial printing of print media that have varying thicknesses over their width or length. In order to bring the surface to be printed of such print media with a thickness variation into an optimal position relative to the printing face during printing, these embodiments of the device according to the invention provide that the first transport unit 5 and/or the second transport unit 6 is pivotable with respect to the printing face 3. The pivotability of the transport units 5, 6 allows an inclination of the transport surfaces 5*c* or 6*c* of the transport units 5 and 6 relative to printing face 3. The transport surfaces 5*c*, 6*c* are expediently inclined, as shown in FIGS. 7 and 8, in the direction S perpendicular to the transport direction R. The inclination of the transport surfaces 5*c*, 6*c* of the transport units 5, 6 can guarantee that the surfaces to be printed of the print media 1 lying on the transport surfaces of the transport units 5, 6 are brought into a plane parallel to the printing face 3. By simultaneously adjusting the height of the transport units 5, 6 relative to the print head 2, the surfaces of the print media to be printed can thus be brought into a plane parallel to the printing face 3 with a distance therefrom suitable for printing.

The transport surfaces 5*c*, 6*c* are expediently inclined by pivoting the first transport unit 5 or the second transport unit 6 relative to the print head 2. In the embodiment illustrated in FIG. 8, each of the two transport units 5, 6 is seated on at least two spindles 20, 21. These spindles 20, 21 are arranged separated from one another in a direction S perpendicular to the transport direction R. The spindles 20, 21 are coupled to a motor such as a servomotor and can be moved independently thereby in order to realize the inclination of the transport unit 5 or 6.

Figure 9:
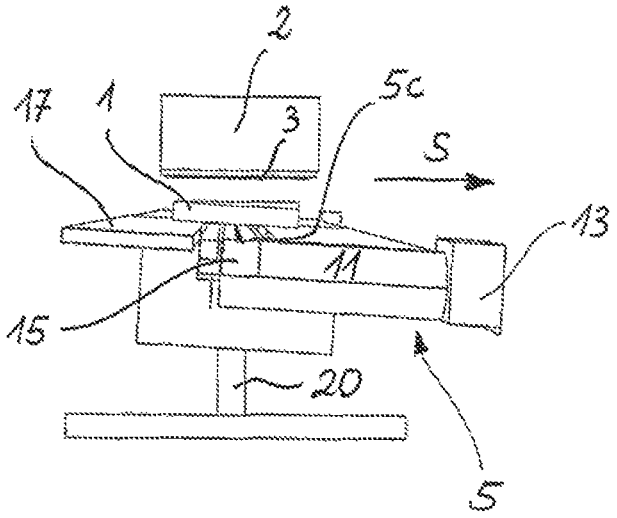
FIG. 9: representation of a fourth embodiment of a device according to the invention for serial printing of print media, viewed in the transport direction.

In the embodiment shown in FIG. 9, the two transport units 5, 6 are each seated on only a single spindle 20. In this embodiment, the transport surfaces 5*c* or 6*c* are inclined relative to the printing face 3 by adjustment means that are not shown.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. A device for serial printing of print media with a print head having a planar printing face and a printing area extending longitudinally in a transport direction, and with a transport device for feeding the print media to be printed to the print head, wherein the transport device comprises:

a first transport unit and a second transport unit each having a moving transporting surface, the transport units arranged one after the other along the longitudinal direction to thereby move the print media along the longitudinal direction and past the printing face, the first and second transport units each independently adjustable to move in an orthogonal direction with respect to the printing face to reposition the transporting surface at a predetermined distance relative to the printing face while maintaining the transporting surface parallel to the printing face, the first and second transport units thereby arranged to guide a print medium from the first transport unit to the second transport unit through a transfer area and past the printing face of the print head and at a distance away from the printing face that is suitable for printing; and a first drive and a second drive associated with the first transport unit and the second transport unit, respectively, each of said first and second drives enabling the associated transport unit to be adjusted in the orthogonal direction;

each of the first and second transport units having an upstream end and a downstream end as viewed in the transport direction, wherein the downstream end of the upstream transport unit as viewed in the transport direction is downstream of the upstream end of the downstream transport unit, and the downstream end of the upstream transport unit is laterally offset with respect to the upstream end of the downstream transport unit.

2. Device according to claim 1, wherein the first and second transport units are each constructed as suction belts that hold a print medium on the respective transport surface by means of negative pressure.

3. Device according to claim 1, wherein each of the first and second transport units has a first roller at the upstream end and a second roller at the downstream end, wherein at least one of the first and second rollers is driven by a motor.

4. The device of claim 1, wherein one of the first drive and second drive includes a single motor and the other of the first drive and second drive includes a coupling connected to the single motor.

5. Device according to claim 1, wherein at least one of the first transport unit and the second transport unit is pivotable relative to the printing face.

6. A device for serial printing of print media with a print head having a planar printing face and a printing area extending longitudinally in a transport direction, and with a transport device for feeding the print media to be printed to the print head, wherein the transport device comprises:

a first transport unit and a second transport unit each having a moving transporting surface, the transport units arranged one after the other along the longitudinal direction to thereby move the print media along the longitudinal feed direction past the printing face, the first and second transport units each independently adjustable to move in an orthogonal direction with respect to the printing face to thereby reposition the transporting surface at a changed distance relative to the printing face while maintaining the transporting surface parallel to the printing face, the first and second transport units thereby arranged to move a print medium along the longitudinal feed direction through a transfer area from the first transport unit to the second transport unit at a distance away from the printing face that is suitable for printing;

a first drive and a second drive associated with the first transport unit and the second transport unit, respectively, each of the first drive and second drive configured to independently change a height of the associated transport unit in the orthogonal direction;

each of the first and second transport units having an upstream end and a downstream end as viewed in the transport direction, wherein the downstream end of the upstream transport unit as viewed in the transport direction is downstream of the upstream end of the downstream transport unit, and the downstream end of the upstream transport unit is laterally offset with respect to the upstream end of the downstream transport unit.

7. The device of claim 6, wherein the length of the transfer area in the longitudinal direction is configured to depend on the dimension of the print media to be transported.

8. The device of claim 6, further including a sensor for determining the thickness of the print media.

9. The device of claim 8, wherein output from the sensor is used to cause the orthogonal adjustment of the at least one of the first and second transport conveyors.

10. The device of claim 6, wherein the printing face defines a plane, and wherein at least one of the first and second transport conveyors can be pivoted with respect to the plane of the printing face.

11. The device of claim 6, wherein the first and second transport conveyors convey the print media at different speeds.

12. The device of claim 6, wherein the at least one of the first and second drives includes at least one of a servo motor and a linear motor.

13. The device of claim 6, wherein the first and second transport conveyor are laterally offset and overlap along the longitudinal direction.

14. The device of claim 6, wherein downstream end of the upstream transport unit is a first roller, and the upstream end of the downstream transport unit is a second roller, the first and second rollers laterally offset with respect to each other.

15. The device of claim 6, wherein the transport units move the print media along the longitudinal feed direction past and under the printing face.

16. A method for serial printing of print media, comprising:

serially feeding the print media to be printed past a print head having a planar printing face and a printing area extending longitudinally in a transport direction, using a transport device for feeding the print media to be printed to the print head, wherein the transport device includes:

a first transport unit and a second transport unit each having a moving transporting surface, the transport units arranged substantially end to end to thereby move the print media along the longitudinal direction and past the printing face, the first and second transport units each independently adjustable to move in an orthogonal direction with respect to the printing face to reposition the transporting surface at a predetermined distance relative to the printing face while maintaining the transporting surface parallel to the printing face, the first and second transport units thereby arranged to guide a print medium from the first transport unit to the second transport unit through a transfer area and past the printing face of the print head and at a distance away from the printing face that is suitable for printing, a first drive and a second drive associated with the first transport unit and the second transport unit, respectively, each of said first and second drives enabling the associated transport unit to be adjusted in the orthogonal direction;

each of the first and second transport units having an upstream end and a downstream end as viewed in the transport direction, wherein the downstream end of the upstream transport unit as viewed in the transport direction is downstream of the upstream end of the downstream transport unit, and the downstream end of the upstream transport unit is laterally offset with respect to the upstream end of the downstream transport unit.

* * * * *